United States Patent [19]

Ferrario et al.

[11] Patent Number: 4,665,343

[45] Date of Patent: May 12, 1987

[54] LOW METHANE GETTER DEVICE

[75] Inventors: Bruno Ferrario; Daniele Martelli; Claudio Boffito, all of Milan, Italy

[73] Assignee: S.A.E.S. Getters S.p.A., Milan, Italy

[21] Appl. No.: 737,078

[22] Filed: May 23, 1985

[30] Foreign Application Priority Data

Jul. 5, 1984 [IT] Italy ..... 21767 A/84

[51] Int. Cl.[4] ..... H01J 17/24

[52] U.S. Cl. ..... 313/553; 417/51; 252/181.1

[58] Field of Search ..... 313/550, 561, 556, 481, 313/553; 417/48, 51; 252/181.1, 181.2, 181.5, 181.7

[56] References Cited

U.S. PATENT DOCUMENTS

| | | | |
|---|---|---|---|
| 2,018,965 | 10/1935 | McQuade | 252/181.7 |
| 2,029,144 | 1/1936 | Wiegand | 313/550 |
| 3,102,633 | 9/1963 | Baronetzky | 313/553 |
| 3,225,910 | 12/1965 | della Porta | 417/48 |
| 3,389,288 | 6/1968 | dela Porta et al. | 313/552 |
| 3,669,567 | 6/1972 | dela Porta et al. | 313/561 |
| 3,927,953 | 12/1975 | Zucchinelli | 417/48 |
| 3,945,949 | 3/1976 | Van Vucht et al. | 313/564 X |
| 4,195,891 | 4/1980 | Hellier | 313/564 X |
| 4,203,049 | 5/1980 | Kuss | 252/181.1 |
| 4,264,280 | 4/1981 | Hellier | 417/51 |
| 4,481,441 | 11/1984 | Van Gils | 313/481 |
| 4,504,765 | 3/1985 | della Porta | 313/561 |

*Primary Examiner*—Stewart J. Levy
*Assistant Examiner*—Hezron E. Williams
*Attorney, Agent, or Firm*—Quaintance, Murphy & Presta

[57] ABSTRACT

A getter device comprises a getter metal vapor releasing material and a source of an alkali metal which releases an alkali metal during or after the latter period of getter metal evaporation. Such getter devices are found to produce less methane after evaporation of the getter metal without producing higher hydrocarbons. A higher pressure of hydrocarbons is formed which aids cathode functioning.

16 Claims, 6 Drawing Figures

LOW METHANE GETTER DEVICE

BACKGROUND OF THE INVENTION

The present invention relates to a getter device producing a reduced amount of methane in the residual gases of a vacuum tube, in particular an electron tube.

Getter devices are well known in the art. They are used for the production and maintenance of very low pressures within vacuum enclosures, such as, electron tubes and other electronic devices. They find particularly wide-spread use in cathode ray tubes used for the visual representation of images or other information. There are many factors which can affect the life of a cathode ray tube (CRT). Whilst the total residual gas pressure in the CRT must be maintained as low as possible, it is also important to have for instance a low partial pressure of oxygen containing gases. These latter are well known to poison the cathodes. It is especially important to have as low a partial pressure as possible of methane as the getter film, usually barium, has a negligible pumping speed for this gas. Although this gas can in effect be pumped by silicate binders used in the preparation of the phosphor layers on the screen during tube operation, its presence is very dangerous as it can cause ion bombardment of the cathodes or lead to their contamination with carbon deposits. The presence of methane within the CRT is apparently caused by the getter device itself. The main cause of the presence of methane would appear to be due to chemical reactions with barium carbide. The barium carbide being formed either from carbon impurities present in the original getter device or from subsequent reaction of the barium film with carbon containing residual gases in the CRT such as carbon monoxide and carbon dioxide. Whatever the reason for the presence of methane after the evaporation of a getter device within a vacuum vessel it is necessary to reduce its partial pressure to as low a value as possible.

Some tube manufacturers tolerate a small amount of methane as it tends to produce a reducing atmosphere which is regarded as beneficial for cathode activation, however, it can still cause ion bombardment of the cathodes with their eventual destruction, or contaminate them with carbon deposits to which some types of cathode are particularly sensitive.

It is therefore an object of the present invention to provide a getter device free from one or more of the defects of prior art getter devices.

Another object of the present invention is to provide a getter device which produces a reduced partial pressure of methane within a vacuum enclosure.

A further object of the present invention is to provide a getter device which provides a suitable gas ambient within an electron device for the activation of the cathode.

Additional objects and inventions of getter devices of the present invention will become apparent to those skilled in the art by reference to the following detailed description thereof and drawings wherein:

DESCRIPTION OF THE INVENTION

The present invention resides in the utilization of an alkali metal, in combination with a getter metal film, as a means of reducing the quantity of methane present in a vaccum vessel without the production of higher molecular weight organic gases and simultaneously providing a reducing atmosphere for the facilitation of cathode activation.

More specifically there is provided a getter device comprising a getter metal vapour releasing material and a source of an alkali metal together with a means for releasing the alkali metal during or after the latter period of getter metal evaporation.

It is known from U.S. Pat. No. 2,018,965 that an alkali metal can be used as a getter material. However, it has to be used as an alloy containing at least about 15% of the alkali metal and in fact U.S. Pat. No. 2,018,965 states that an alloy comprising barium and magnesium or barium, strontium and magnesium is preferred. There is no indication that a very small quantity of alkali metal in combination with another getter material can cause substantial reduction in the quantity of methane produced when such a getter material is caused to evaporate.

In the article by C. T. Campbell and D. W. Goodman, published in the J. Vac. Sci. & Tech., Al (1983) p. 1265–1266, there is described the use of alkali metal additives to nickel for the catalytic hydrogenation of carbon monoxide. Campbell and Goodman furthermore go on to say that potassium caused a marked increase in the steady state rate and selectivity of Ni (100) for higher hydrocarbon ($C_{2+}$) synthesis. However, surprisingly, the present inventors have found that when an alkali metal such as potassium is used as a very small percentage additive to a barium getter film, although the amount of methane formed in a vacuum enclosure is considerably reduced there is no production of higher hydrocarbons ($C_{2+}$) but there is an increase in the hydrogen partial pressure. The reduction in the quantity of methane formed and the lack of production of higher hydrocarbon is beneficial in that the cathodes of the electron tube are not subject to ion bombardment or carbon contamination from these compounds. Furthermore, the increase in hydrogen partial pressure ensures that during activation of the cathodes there is a sufficiently reducing atmosphere to ensure later subsequent good operation of the cathodes.

Figure 1:
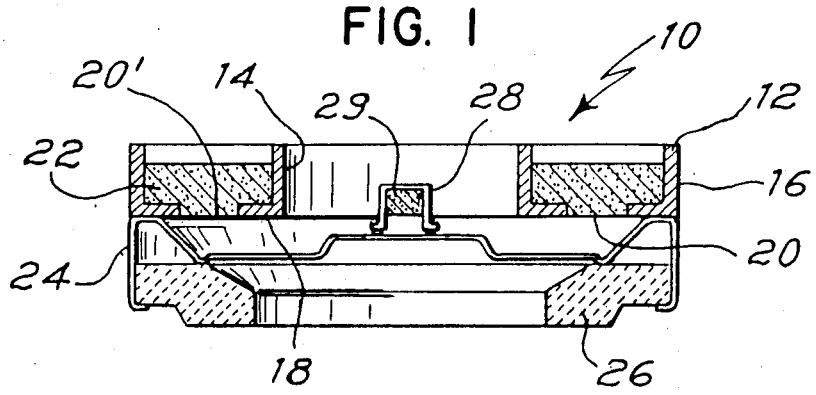
FIG. 1 is a sectional view of a getter device of the present invention.

Referring now to the drawings and in particular to FIG. 1, there is shown a getter device 10 comprising an annular ring 12 having an inner sidewall 14 and an outer sidewall 16. In addition there is a bottom wall 18 joining the inner sidewall to the outer sidewall. In the embodiment shown in FIG. 1 bottom wall 18 is provided with a series of holes 20, 20' so as to facilitate evaporation of getter vapour. Annular ring 12 contains getter metal vapour releasing material 22. In the broadest sense of the invention any getter metal vapour releasing material may be used. However, a preferred metal vapour releasing material is an alloy of approximately 50% wt Ba with Al ($BaAl_4$). Another preferred metal vapour releasing material is a mixture of the above mentioned barium-aluminium alloy with approximately 50% Ni. Preferably the getter metal vapour releasing material should have a particle size less than about 149 μm. The Ni or other additive, such as Ti-Ni compounds, should also have a particle size less than about 149 μm.

The term "getter metal vapour releasing material" as used in the specification and claims herein is meant to include both the material prior to and after getter metal vapour release. This term embraces both the material in the form sold with the getter device and in the form in which it is found in an operating tube wherein the bulk of the getter metal has been evaporated from the material and is in the form of a film on the inside surface of the tube.

To the bottom wall 18 is attached a coupling element 24 which holds an annular ceramic ring 26 for supporting the getter device 10 against the glass wall of an electron tube in a thermally insulated manner. Centrally attached to coupling element 24 is a means 28 for releasing alkali metal in the form of a hollow cylinder containing an alkali metal releasing material 29. During the induction heating of the getter device the central portion of the coupling element heats up later than the annular ring 12 so that alkali metal is released during or after the latter period of getter metal evaporation.

Figure 2:
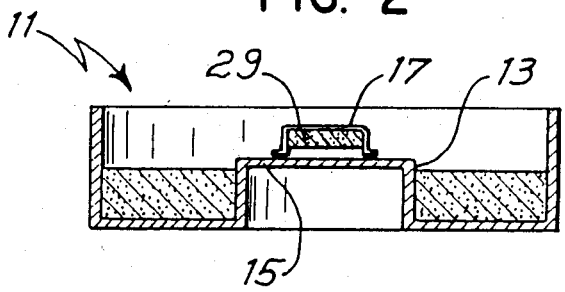
FIG. 2 is a sectional view of an alternative embodiment of the present invention.

FIG. 2 shows an alternative embodiment of a getter device of the present invention in which the getter device 11 has its inner side wall 13 formed integrally round a disc member 15 to which is attached centrally a means 17 in the form of a hollow cylinder supporting an alkali metal releasing material 29.

The alkali metal releasing material could be mixed with the getter metal vapour releasing material and one skilled in the art can take suitable measures to ensure that the alkali metal release takes place during or after the latter stage of getter metal evaporation. However, it is preferred to provide the material in a separate container as indicated as details 17 and 28 above.

The alkali metal releasing material is in the broadest sense of the invention any material that is capable of releasing an alkali metal on heating. However, one preferred family of materials are the alkali metal chromates or di-chromates.

Another preferred family of alkali metal releasing materials are alloys of the alkali metals with other metals. A preferred alkali metal alloy is Ba-M-Al, where M is an alkali metal and may be lithium, sodium, potassium, rubidium or caesium. An especially preferred alkali metal alloy is a novel ternary compound of Ba, M and Al. This plotted on a ternary composition diagram in atomic percent Ba, atomic percent M and atomic percent Al lies within a polygon having as its corners the points defined by:

| | |
|---|---|
| (a) | 14.925% Ba—0.075% M—85% Al |
| (b) | 24.875% Ba—0.075% M—75.05% Al |
| (c) | 24.875% Ba—0.125% M—75% Al |
| (d) | 12.5% Ba—12.5% M—75% Al |
| (e) | 7.5% Ba—12.5% M—80% Al |
| (f) | 7.5% Ba—7.5% M—85% Al |

Preferably this ternary alloy of Ba-M-Al has a composition which when plotted on a ternary composition diagram lies within a polygon having as its corners the points defined by:

| | |
|---|---|
| (a') | 16.67% Ba—0.88% M—82.45% Al |
| (b') | 19.00% Ba—0.88% M—80.12% Al |
| (c') | 19.00% Ba—1.01% M—79.99% Al |
| (d') | 16.01% Ba—4.00% M—79.99% Al |
| (e') | 14.04% Ba—4.00% M—81.96% Al |
| (f') | 14.04% Ba—3.51% M—82.45% Al |

Figure 6:
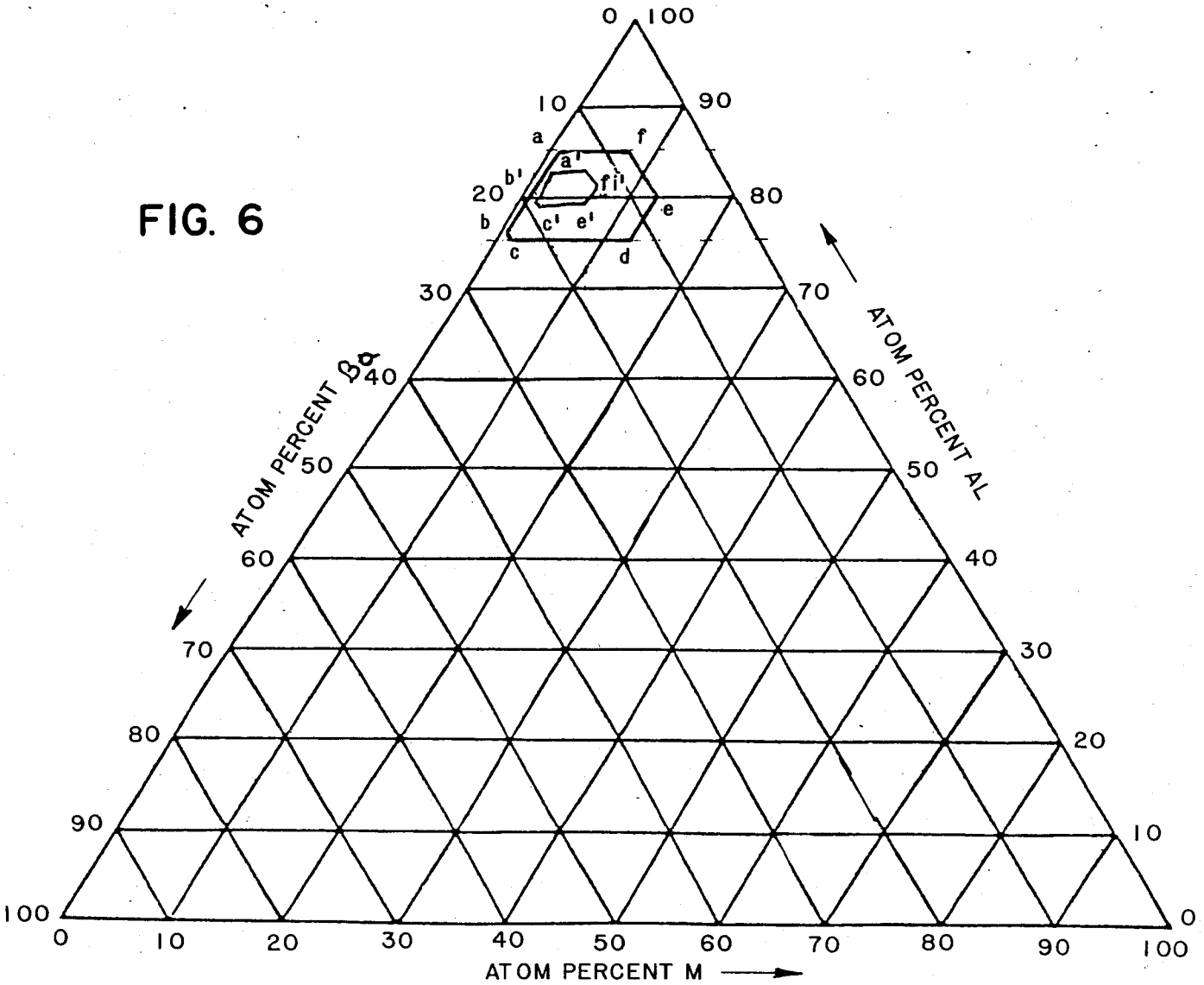
FIG. 6 is a ternary composition diagram showing the composition, in atomic percent, of a novel alloy useful in the present invention.

FIG. 6 is a ternary composition diagram showing, in atomic percent Ba, atomic percent M and atomic percent Al, the composition of ternary alloys useful as the alkali metal releasing materials in the present invention (Note: the polygons shown in FIG. 6 are not drawn to scale).

Of these novel ternary alloys, alloys of Ba-K-Al are particularly useful in the present invention. The preferred alloys of Ba-K-Al are those novel ternary alloys defined by the expression $Ba_xK_{1-x}Al_4$. wherein x has a value from 0.5 to 0.995. Especially prefered alloys of $Ba_xK_{1-x}Al_4$ are those wherein x has a value from 0.8 to 0.95.

These novel ternary alloys, for example alloys of Ba-K-Al, can be produced according to the following process.

Elemental barium, potassium and aluminum are placed in a crucible in weight percentages which are within the polygon described above. The crucible is placed in an induction furnace which is then filled with an inert gas such as argon to prevent evaporation of potassium on heating.

Induction heating to a temperature between 1000° C. and 1300° C. causes the metals to melt and form the ternary alloy on cooling. The cooling takes place under the inert atmosphere. When the alloy has cooled down to ambient temperatures it is removed from the furnace and the ingot is milled to the required particle size.

If the alkali metal chromate is used it is preferably used in admixture with a reducing agent. The reducing agent may be any material which when heated in intimate mixture with the alkali metal chromate causes release of alkali metal vapours, non-limiting examples of suitable reducing agents are Si, Zr-Al alloys such as 84% Zr-16% Al alloy, Zr-Ni alloys, Zr-Fe alloys and ternary alloys such as Zr-V-Fe or Zr-Nb-Ni alloys. The alkali metal releasing material should preferably have a particle size of less than 500 μm and more preferable less than 149 μm and it should be in intimate mixture with the reducing agent in powdered form having a particle size of preferably less than 500 μm and more preferably less than 149 μm. The weight ratio of particulate alkali metal releasing material to reducing agent is preferably in the ratio of from 20:1 to 1:20 and more preferably in the ratio of between 4:1 and 1:1. At lower contents of alkali metal relasing material there is insufficient alkali metal released to cause reduction in methane formation. At higher alkali metal releasing material contents there is insufficient reducing agent to satisfactorily complete the alkali metal releasing reaction with a subsequent lack of control of the exact amount of alkali metal released.

The amount of alkali metal required relative to the amount of getter metal evaporated is any amount that will satisfactorily reduce the quantity of methane produced in a vacuum enclosure. It has been found that the weight ratio of getter metal to alkali metal released is preferably from 9:1 to 999:1 and more preferably from 95:5 to 99:1.

The hollow cylindrical capsule containing the source of alkali metal is located coaxially with the annular ring so that upon heating the getter device by high frequency induced currents the alkali metal is released during and after the latter period of barium evaporation. It will be evident to those skilled in the art that the exact point of time at which release of the alkali metal vapours starts relative to the release of getter material vapours can be controlled by means of the exact positioning of the capsule and by suitable choice of the reducing agent.

The invention will further be illustrated by reference to the following examples in which all percentages are expressed in wt % unless otherwise stated.

EXAMPLE 1

Figure 3:
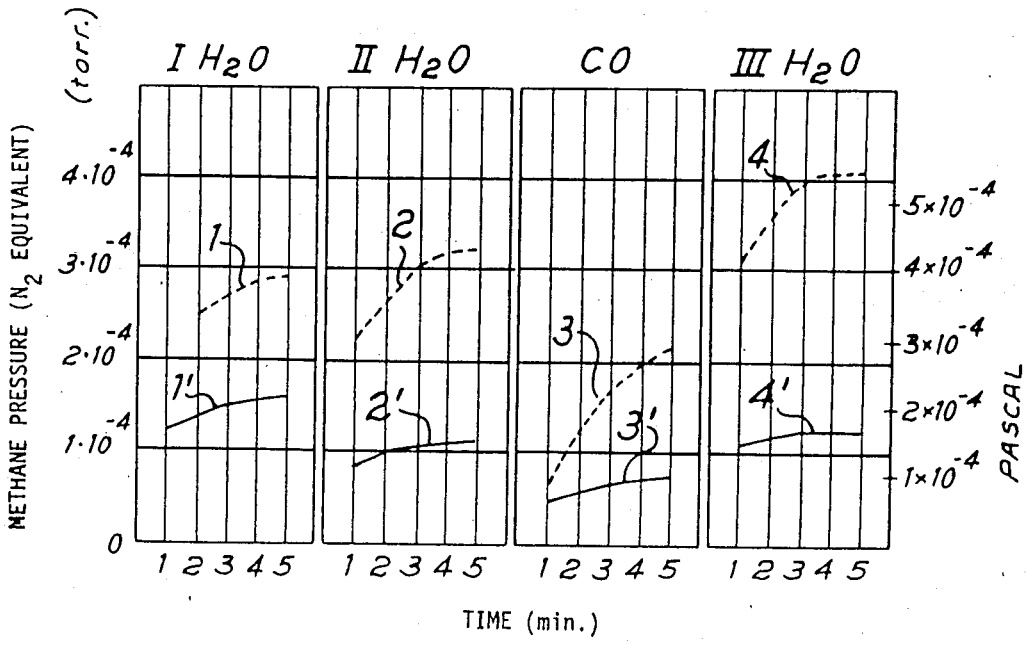
FIG. 3 is a graphical representation of the results of some methane forming experiments performed using getter devices of the present invention in comparison with traditional getter devices.

This example is NOT representative of the present invention but has been performed as a comparative example to demonstrate various properties of a traditional getter device. An annular ring was filled with about 1000 mg of a mixture of a $BaAl_4$ alloy with nickel in equal proportions. The particle size of both the $BaAl_4$ and Ni being less than 149 μm. The getter device had a nominal barium content of about 250 mg. The getter device was placed in a vacuum system having a volume of approximately 8 liters. The system was then evacuated to a pressure of less than $6.7\times10^{-6}$ Pa. whereupon the getter device was heated by high frequency induction currents to cause evaporation of barium. The system was then re-evacuated to a pressure of less than $6.7\times10^{-5}$ Pa. In order to simulate the production of methane by the getter device a pressure of $9.3\times10^{-4}$ Pa of water vapour was introduced into the system and the atmosphere in the system was analyzed by means of a mass spectrometer for a period of approximately 5 minutes. The partial pressure of methane in the system is shown in FIG. 3 as curve 1. The system was then repumped to a pressure of less than $6.7\times10^{-5}$ Pa and a further quantity of water vapour was introduced to a pressure of $9.3\times10^{-4}$ Pa. The methane partial pressure was again measured and is shown in FIG. 3 as curve 2. The system was again pumped down to a pressure of less than $6.7\times10^{-5}$ Pa and CO was introduced to a pressure of $2.7\times10^{-2}$ Pa. This quantity of carbon monoxide was calculated so as to completely saturate the barium film and thus simulate the conditions within a CRT towards the end of its functioning life. Again, the methane pressure was measured and is shown in FIG. 3 as curve 3. The system was again evacuated to a pressure of less than $6.7\times10^{-5}$ Pa and a further quantity of water vapour was introduced to a pressure of $9.3\times10^{-4}$ Pa. Measurement of the methane partial pressure is shown in FIG. 3 as curve 4.

At approximately 5 minutes from the introduction of both the water vapour and carbon monoxide, the partial pressure of hydrogen and other gases in the system were also measured. The partial pressure of the reducing gas, hydrogen, is reported in Column 1 of Table 1.

EXAMPLE 2

This example was performed to show various properties of a getter device of the present invention.

A getter device was manufactured in all respects equal that of the getter device used in Example 1 with the exception that a source of potassium was supplied in the form of a cylindrical capsule located coaxially with the annular ring of the getter device. The hollow cylindrical capsule contained a mixture of potassium chromate and a 16% Al-84% Zr alloy in the weight ratio of 1:3 in such an amount as to be able to release approximately 2.5 to 3 mg of elemental potassium. The gas introduction procedure of Example 1 was followed in all respects and the methane pressure was measured and the curves obtained are shown in FIG. 3 as curves 1', 2', 3' and 4' respectively. Furthermore, the partial pressure of hydrogen and other gases in the system was measured at approximately 5 minutes after the gas emission and the results are shown in Column 2 of Table 1.

Description of Test Procedure

Figure 4:
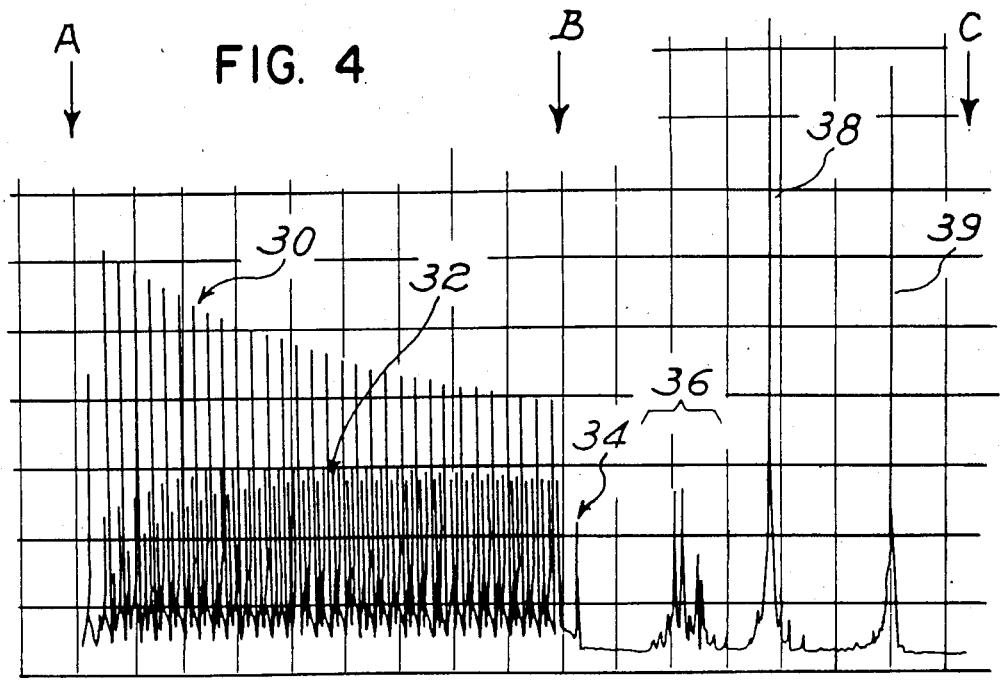
FIGS. 4 and 5 are mass spectra representative of the gas atmosphere within a closed vessel containing getter devices.

The test results leading to the graphs of FIG. 3 were obtained by analyzing the system atmosphere using a Leybold Heraeus Q200 quadropole mass spectrometer. After introduction of the water vapour the mass spectrometer was caused to repeatedly scan the atomic mass range 14 to 19 thus measuring the mass 18 peak of water ($H_2O^+$) and the mass 15 peak of methane ($CH_3$). FIG. 4 shows the chart recording of the mass spectrometer measurements obtained during the test leading to curve 4' of FIG. 3. The mass 18 peaks of water are indicated as detail 30 and the mass 15 peaks of methane are indicated as detail 32.

Point A indicates the start of the test when the water vapour has just been introduced into the system in which the getter device has been caused to evaporate barium (and, in the case of FIG. 4 also potassium). It can clearly be seen that the partial pressure of the water vapour decreases as it reacts with, and is sorbed by, the barium film. The peak height on the graph of FIG. 4 is converted to pressure (in nitrogen equivalent pressure) as indicated on FIG. 3 by means of a previous calibration of the mass spectrometer. After about 5 minutes the test is terminated at point B and the mass spectrometer is caused to analyze the complete atmosphere in the system by scanning the complete m/e range 1-60, which takes a time of approximately 6 minutes. (Range B to C in FIG. 4).

The complete analysis clearly shows the presence of hydrogen as the atomic mass 2 peak indicated as detail 34. This peak being recorded approximately 6 minutes after the CO and $H_2O$ introduction. There is also evident the cracking pattern 36 of methane, the mass 28 peak (detail 38) of $CO+N_2$ and the mass 48 peak (detail 39) of $CO_2$.

Figure 5:
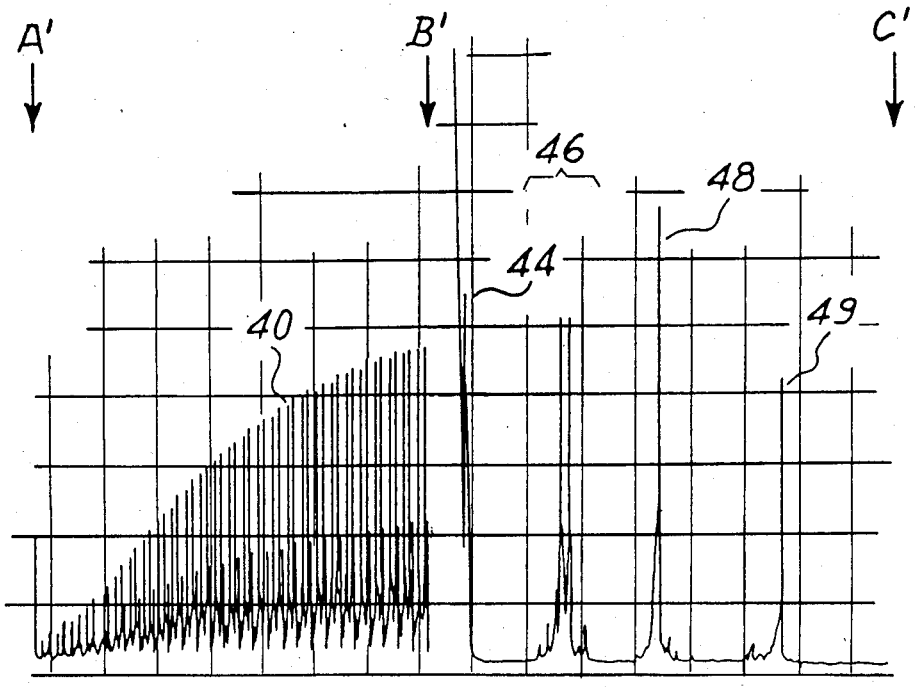

FIG. 5 is similar to FIG. 4 except that it shows the mass spectrometer analysis during the test leading to curve 3 of FIG. 3, that is after the introduction of CO to the system in which a traditional getter device had been caused to evaporate barium. A' indicates the moment at which the CO is introduced into the system. Again, the mass spectrometer repeatedly scanned the mass 14 to 19 peaks and the mass 15 peak of methane (detail 40) was recorded.

The CO peak (mass 28) is not recorded as it is outside the repeated scanning range of mass 14 to 19. After about 5 minutes the test is terminated at point B' and the complete atmosphere is then analyzed by scanning the 1-60 mass range (points B' to C'). Clearly visible are the mass 2 peak (detail 44), the methane cracking pattern peaks, 46, the mass 28 peak (detail 48) of $CO+N_2$ and the mass 48 peak (detail 49).

No importance should be attached to the relative heights of the hydrogen mass 2 peaks (details 34 and 44) as different scale settings were used, the actual values converted into partial pressure ($N_2$ equivalent) are reported in Table 1. In addition the scale settings of peaks details 38, 39, 48 and 49 are at a sensitivity of about ×100 greater than the scales of peaks 34, 44.

Discussion of the Results

It can be seen from the curves of FIG. 3 that at all stages of gas introduction whether it be water vapour or carbon monoxide that the methane partial pressure above getters of the present invention as shown by curves 1', 2', 3' and 4' are considerably lower than the methane pressures in the system using the conventional getter devices as shown by curves 1, 2, 3 and 4.

By comparison of Columns 1 and 2 of Table 1 it can be seen that getter devices of the present invention incorporating an alkali metal also have a higher hydrogen pressure in the residual atmosphere and thus can ensure a more reducing atmosphere to aid cathode activation and life.

Examination of the atmospheric analysis of regions B–C and B'–C' of FIGS. 4 and 5 respectively show identical structures (except for magnitude) thus indicate no production of higher hydrocarbons, which production would have been expected from the teachings of Campbell and Goodman supra. As further evidence of the lack of production of higher hydrocarbons, there is absolutely no evidence of cracking pattern formation around the mass zones 29, 43 and 58 which would have been expected from any higher hydrocarbons than methane.

TABLE I

| | COLUMN 1 Pressure of $H_2$($Pa/N_2$ equivalent) after about 6 minutes from gas admission | COLUMN 2 |
|---|---|---|
| GAS | Ba | Ba + K |
| I $H_2O$ | $1.03 \cdot 10^{-5}$ | $2.67 \cdot 10^{-4}$ |
| II $H_2O$ | $1.60 \cdot 10^{-5}$ | $2.40 \cdot 10^{-4}$ |
| CO | $6.12 \cdot 10^{-6}$ | $1.33 \cdot 10^{-4}$ |
| III $H_2O$ | $1.60 \cdot 10^{-5}$ | $3.47 \cdot 10^{-4}$ |

Although the invention has been described in detail with reference to certain preferred embodiments and uses, it is intended that variations and/or modifications can be carried out while still remaining within the spirit and scope of the invention.

What is claimed is:

1. A getter device comprising:

A. a getter metal vapour releasing material; and

B. means for effecting getter metal evaporation from said getter metal vapour releasing material; and C. a source of an alkali metal; and D. means for releasing the alkali metal during the latter period of getter metal evaporation wherein the getter device produces less methane after evaporation of the getter material without producing higher hydrocarbons.

2. A getter device of claim 1 in which the alkali metal source comprises an alkali metal chromate.

3. A getter device of claim 1 in which the alkali metal source is an alkali metal alloy.

4. A getter device comprising:

A. a getter metal vapour releasing material; and

B. means for effecting getter metal evaporation from said getter metal vapour releasing material; and C. a source of an alkali metal; and D. means for releasing the alkali metal during the latter period of getter metal evaporation;

wherein the alkali metal source is a ternary compound $Ba_xM_{1-x}Al_4$ where M is chosen from the group consisting of Li, Na, K, Rb and Cs.

5. A getter device of claim 4 in which x has a value from 0.5 to 0.995.

6. A getter device of claim 4 in which x has a value from 0.8 to 0.95.

7. A getter device of claim 4 which upon heating releases getter metal and alkali metal in a weight ratio getter metal to alkali metal from 9:1 to 999:1.

8. A getter device comprising:

I. an annular ring having:

an inner side wall, an outer sidewall, and a bottom wall joining the inner side wall to the outer sidewall; and II. a getter metal vapour releasing material supported by said ring comprising:

A. a particulate intermetallic compound of composition $BaAl_4$ having a particle size of less than 149 μm in intimate mixture with, B. particulate nickel having a particle size of less than 149 μm and wherein the weight ratio of $BaAl_4$:Ni is between 2:1 and 1:2; and III. a source of potassium comprising A. particulate potassium chromate having a particle size of less than 149 μm in intimate mixture with, B. a particulate zirconium aluminium alloy having a composition of 84% by weight zirconium, balance aluminium, and a particle size less than 149 μm wherein the weight ratio of potassium chromate:zirconium aluminium alloy is between 4:1 and 1:1; and IV. a hollow cylindrical capsule containing said source of potassium located coaxially with said annular ring, whereby upon heating said getter device by high frequency induced currents at least some of the potassium is released after the latter period of barium evaporation, with the proviso that the weight ratio of barium to potassium released is from 95:5 to 999:1.

9. A getter device comprising:

A. a getter metal vapour releasing material; and

B. means for effecting getter metal evaporation from said getter metal releasing material; and C. a source of an alkali metal and D. means for releasing the alkali metal after the latter period of getter metal evaporation wherein the getter device produces less methane after evaporation of the getter material without producing higher hydrocarbons.

10. A getter device comprising:

A. a getter metal vapour releasing material; and

B. means for effecting getter metal evaporation from said getter metal vapour releasing material; and C. a source of an alkali metal; and D. means for releasing the alkali metal during the latter period of getter metal evaporation;

wherein the alkali metal source is a ternary compound of Ba-M-Al, wherein M is an alkali metal elected from a group consisting of lithium, sodium, potassium, rubidium and caesium, said ternary compound having a composition which when plotted on a ternary composition diagram in atomic percent Ba, atomic percent M and atomic percent Al lies within a polygon having as its corners the points defined by

| | | | |
|---|---|---|---|
| (a) | 14.925% | Ba—0.075% | M—85% Al, |
| (b) | 24.875% | Ba—0.075% | M—75.05% Al, |
| (c) | 24.875% | Ba—0.125% | M—75% Al, |
| (d) | 12.5% | Ba—12.5% | M—75% Al, |
| (e) | 7.5% | Ba—12.5% | M—80% Al, and |
| (f) | 7.5% | Ba—7.5% | M—85% Al. |

11. A ternary compound of Ba-M-al useful as an alkali metal source, said M being an alkali metal selected from the group consisting of lithium, sodium, potassium, rubidium and caesium, said ternary compound having a composition which when plotted on a ternary composition diagram in atomic percent Ba, atomic percent M and atomic percent Al lies within a polygon having as its corners points defined by

| | | | |
|---|---|---|---|
| (a) | 14.925% | Ba—0.075% | M—85% Al, |
| (b) | 24.875% | Ba—0.075% | M—75.05% Al, |
| (c) | 24.875% | Ba—0.125% | M—75% Al, |
| (d) | 12.5% | Ba—12.5% | M—75% Al, |
| (e) | 7.5% | Ba—12.5% | M—80% Al, and |
| (f) | 7.5% | Ba—7.5% | M—85% Al. |

12. A ternary compound of claim 11, said ternary compound having a composition which when plotted on a ternary composition diagram in atomic percent Ba, atomic percent M and atomic percent Al lies within a polygon having as its corners points defined by

| | | | |
|---|---|---|---|
| (a') | 16.67% | Ba—0.88% | M—82.45% Al, |
| (b') | 19.00% | Ba—0.88% | M—80.12% Al, |
| (c') | 19.00% | Ba—1.01% | M—79.99% Al, |
| (d') | 16.01% | Ba—4.00% | M—79.99% Al, |
| (e') | 14.04% | Ba—4.00% | M—81.96% Al, and |
| (f') | 14.04% | Ba—3.51% | M—82.45% Al. |

13. A getter device of claim 4 in which the alkali metal source is a ternary compound of the formula $Ba_xK_{1-x}Al_4$, wherein x has a value from 0.5 to 0.995.

14. A getter device of claim 4 in which the alkali metal source is a ternary compound of the formula $Ba_xK_{1-x}Al_4$, wherein x has a value from 0.8 to 0.95.

15. A getter device comprising:

I. an annular ring having:

an inner side wall, an outer side wall, and a bottom wall joining the inner side wall to the outer side wall; and II. a getter metal vapour releasing material supported by said ring comprising:

A. a particulate intermetallic compound of composition $BaAl_4$ having a particle size of less than 149 μm in intimate mixture with, B. particulate nickel having a particle size of less than 149 μm and wherein the weight ratio of $BaAl_4$:Ni is between 2:1 and 1:2; and III. a source of potassium comprising a ternary compound of the formula $Ba_xK_{1-x}Al_4$, wherein x has a value from 0.5 to 0.995, and IV. a hollow cylindrical capsule containing said source of potassium located coaxially with annular ring, whereby upon heating said getter device by high frequency induced currents there is barium evaporation from said getter metal vapour releasing material and at least some of the potassium is released after the latter period of barium evaporation, with the proviso that the weight ratio of barium to potassium released is from 95:5 to 999:1.

16. A getter device comprising:

A. a barium vapour releasing material; and

B. means for effecting barium evaporation from said barium vapour releasing material; and C. a source of an alkali metal; and D. means for releasing the alkali metal during the latter period of barium evaporation wherein the getter device produces less methane after evaporation of the getter material without producing higher hydrocarbons.

* * * * *